US008082725B2

(12) United States Patent
Younsi et al.

(10) Patent No.: US 8,082,725 B2
(45) Date of Patent: Dec. 27, 2011

(54) ELECTRO-DYNAMIC SWIRLER, COMBUSTION APPARATUS AND METHODS USING THE SAME

(75) Inventors: Abdelkrim Younsi, Ballston Lake, NY (US); Seyed Gholamali Saddoughi, Clifton Park, NY (US); John Thomas Herbon, Rexford, NY (US); Florian Peter Pintgen, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1536 days.

(21) Appl. No.: 11/734,370

(22) Filed: Apr. 12, 2007

(65) Prior Publication Data

US 2009/0064661 A1 Mar. 12, 2009

(51) Int. Cl.
*F02C 5/00* (2006.01)
*F02G 1/00* (2006.01)

(52) U.S. Cl. ..... 60/39.76; 60/247; 60/737; 431/8

(58) Field of Classification Search ..... 60/737, 60/738, 747, 39.76, 748, 247, 39.38; 431/8, 431/9, 12, 2, 354
See application file for complete search history.

(56) References Cited

U.S. PATENT DOCUMENTS

| | | | | |
|---|---|---|---|---|
| 6,666,018 | B2 | 12/2003 | Butler et al. | |
| 7,093,794 | B2 | 8/2006 | Leyva et al. | |
| 7,137,808 | B2 * | 11/2006 | Branston et al. | 431/8 |
| 2003/0136108 | A1 * | 7/2003 | Meholic et al. | 60/204 |
| 2003/0175565 | A1 * | 9/2003 | Noda | 429/21 |
| 2005/0170301 | A1 * | 8/2005 | Pavlik et al. | 431/2 |
| 2005/0249324 | A1 | 11/2005 | Meacham | |

FOREIGN PATENT DOCUMENTS

| | | | |
|---|---|---|---|
| EP | 0936406 | A2 | 8/1999 |
| EP | 1350943 | A2 | 10/2003 |
| EP | 1533050 | A1 | 5/2005 |
| EP | 1435447 | B1 | 6/2006 |
| EP | 1435440 | B1 | 7/2006 |

OTHER PUBLICATIONS

Mass Analyzer with Rotating Electric Fields; Master Bond Inc.; "Orthogonal dipole electric fields would disperse incident ions according to their charge-to-mass ratio, analogous to making Lissajous figures with ions"; 4 pages; Sep. 6, 2006; http://www.nasatech.com/Briefs/Feb98/NPO19682.html.

T. Hasegawa et al.; "Stability of a Penning trap with a quadrupole rotating electric field"; Physical Review A 71 023406 (2005); Received Sep. 29, 2004; 6 pages.

CN Search Report CPME0840868, Application No. 200810092458.9, Nov. 19, 2010.

* cited by examiner

*Primary Examiner* — Michael Cuff
*Assistant Examiner* — Andrew Nguyen
(74) *Attorney, Agent, or Firm* — Richard A. DeCristofaro

(57) ABSTRACT

In one embodiment, a combustion apparatus comprises: an oxidant inlet, a fuel inlet, a mixing zone configured to mix fuel and oxidant to form a mixture, a combustion zone in fluid communication with the mixing zone and configured to combust the mixture, and an outlet in fluid communication with the combustion zone. The mixing zone, the combustion zone, and/or the outlet comprises an electro-dynamic swirler configured to swirl ionized gas. The electro-dynamic swirler comprises a plurality of electrodes in electrical communication with a power source. In one embodiment, a method of creating thrust comprises: mixing a fuel and an oxidant to form a mixture, igniting the mixture to form an ignited mixture, combusting the ignited mixture to form a flame, and using the flame to create thrust, wherein the flame and/or the fuel and oxidant are electro-dynamically swirled.

12 Claims, 5 Drawing Sheets

ELECTRO-DYNAMIC SWIRLER, COMBUSTION APPARATUS AND METHODS USING THE SAME

BACKGROUND

This application relates generally to electro-dynamic swirlers, and especially to combustion devices that comprise electro-dynamic swirlers, and methods for using the same.

Various thrust and power generation apparatuses, e.g., gas turbines, combust a mixture of air and fuel. In gas turbines, fuel-air mixture is continually supplied to a combustor where they are continually burned to produce hot combustion gases. These gases are expanded through one or more turbine stages, creating mechanical power and, in some cases, propulsive thrust. Pulse detonation engines detonate a fuel-air mixture, producing hot combustion gases which have increased temperature and pressure. The hot combustion gases are directed from the engine to produce thrust.

In a pulse detonation engine, as shown in FIGS. 1A-1F, a spark initiates the mixture and starts out as a deflagration which transitions via deflagration to detonation transition (DDT) to a fully developed detonation. The expanding hot combustion products act like a piston, accelerating the flame front. (FIG. 1A) The flame front gets more wrinkled and corrugated (FIG. 1B) and increases flame surface area as it accelerates and transitions to a turbulent flame (FIG. 1C). The increase in flame surface area leads further to an acceleration in propagation velocity and the creation of compression waves (FIG. 1D), which get amplified to shock waves during the acceleration process. If the shock waves are strong enough to increase the gas temperature of the reactant and start interacting within the confinement, a localized explosion takes place (FIG. 1E), which leads to a locally overdriven detonation wave, and a coupling between shock and reaction zone. As soon as this coupling has been established a detonation wave is formed. (FIG. 1F)

Exemplary fuel and air mixtures for pulse detonation engines include gaseous and liquid fuel and air mixtures. One problem with detonations in fuel/air mixtures with low volatility is a long deflagration-to-detonation transition (DDT) length. Attempts have been made to decrease the DDT length by placing obstacles and other turbulence-enhancing geometries inside a detonation chamber. One particular augmentation device is threaded in the interior surface of the inlet end of the detonation chamber with a helical-type thread to provide a ridged surface. Other attempts to decrease the DDT length include using pre-detonators and improving the combination of spark energy and position, detonation chamber geometry, shock focusing, and fuel/air properties. Although some success has been achieved, shorter DDT lengths and time remains a central challenge for low volatility detonation systems, like e.g. liquid fuel systems.

It would therefore be desirable to enhance air-fuel mixing, reduce the DDT length, and/or enhance control over the flame acceleration process and the developing detonation.

SUMMARY

Disclosed herein are embodiments of apparatus comprising electro-dynamic swirlers methods for using the same.

In one embodiment, a combustion apparatus comprises: an oxidant inlet, a fuel inlet, a mixing area in fluid communication with the fuel inlet and the oxidant inlet, a combustion zone in fluid communication with the mixing area and configured to combust the mixture, and an outlet in fluid communication with the combustion zone. The mixing area, the combustion zone, and/or the outlet comprises an electro-dynamic swirler configured to swirl ionized gas. The electro-dynamic swirler comprises a plurality of electrodes in electrical communication with a power source.

In one embodiment, a pulse detonation apparatus comprises: a fuel inlet, an oxidant inlet, a mixing area in fluid communication with the fuel inlet and the oxidant inlet, a detonation chamber located downstream of and in fluid communication with the mixing area, and a detonation outlet located downstream of and in fluid communication with the detonation chamber. The mixing area, detonation chamber, and/or detonation outlet comprise an electro-dynamic swirler. The electro-dynamic swirler comprises a plurality of electrodes in electrical communication with a power source.

In one embodiment, a method of creating thrust comprises: electro-dynamically swirling a fuel and an oxidant to form a mixture, igniting the mixture to form an ignited mixture, combusting the ignited mixture to form a flame, and using the combustion exhaust to create thrust.

In another embodiment, a method of creating thrust comprises: mixing a fuel and an oxidant to form a mixture, igniting the mixture to form an ignited mixture, combusting the ignited mixture to form a flame, electro-dynamically swirling the flame, and using the flame to create thrust.

The above described and other features are exemplified by the following figures and detailed description.

BRIEF DESCRIPTION OF THE DRAWINGS

Reference is now made to the figures, which are exemplary, not limiting, and wherein like numbers are numbered alike.

DETAILED DESCRIPTION

Figure 1A:
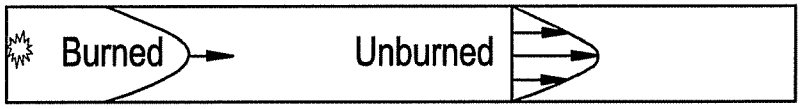
FIGS. 1A-1F depict an exemplary deflagration to detonation transition process as observed in a combustible mixture in a tube.
Figure 1B:
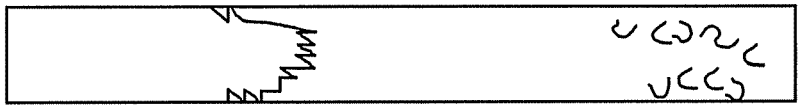
Figure 1C:
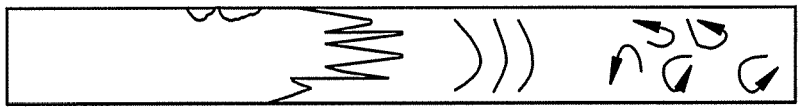
Figure 1D:
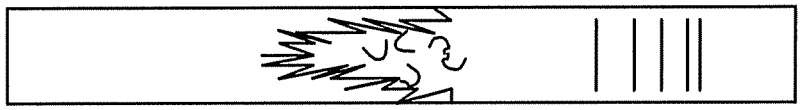
Figure 1E:
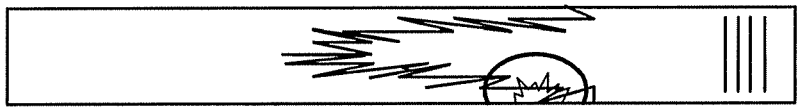
Figure 1F:
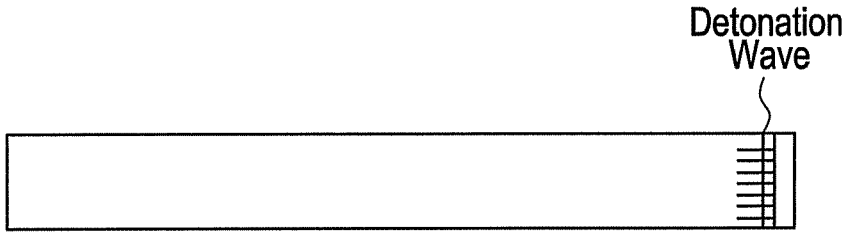

An electro-dynamic swirler is employed to attain the benefit of the effect of an electric rotating field on a combustion mixture (e.g., a fuel and air mixture prior to combustion) and/or on the resultant flame. The air alone or fuel/air mixture is pre-ionized using an electrical discharge or plasma. The plasma can be obtained using a separate set of electrodes energized at a voltage higher than the sparking voltage of the air alone or fuel/air mixture. The plasma can also be produced by the rotating electric field of the electro-dynamic swirler itself when the voltage is higher than the sparking voltage of the air alone or fuel/air mixture. The swirler comprises a plurality of electrodes connected in groups to create a rotating electric field when energized. The rotating field acts on ions passing through the field. The ions, which gain momentum from the electric field, transfer the momentum to neutral species in the gas, inducing a circular like flow; e.g., setting the flame or gas mixture in a circular motion. This effect can be employed to mix fluids (e.g., fuel and oxidant (such as air)) with little or no pressure drop, to shape a flame (e.g., expand a flame in a pulse detonation apparatus), to direct a flame, to stabilize a flame, and/or to modify acoustics (e.g., sense vibration and/or emission acoustics). Information on how the electro-dynamic swirler affects the flame can be used to adjust a flame as desired.

The electro-dynamic swirler can be used in various combustion devices such as pulse detonation engines, engine augmenters, and so forth. It can be employed before the combustion (e.g., replacing a mechanical swirler (air/fuel mixer), or in addition to the air/fuel mixer) as long as charged particles are present or intentionally created (e.g., using a plasma discharge), in the combustion chamber, and/or in the detonation section. The electro-dynamic swirler would produce a rotating field that would act on ions contained in the stream (e.g., pre-ionized fuel/air mixture, flame, combustion gases, or the like) going through the device. The momentum gained by the ions from the electric field is transferred to the neutral species and the flame or gases are set in circular motion. The speed of rotation of the electric field is a function of the number of segmented electrodes and the voltage frequency.

The electro-dynamic swirler can comprise a plurality of electrodes. The electrodes are pieces of conductive material (e.g., rod, wire, strip, pad, and so forth, as well as combinations comprising at least one of the foregoing) which may be further coated with an insulating material such as a ceramic coating. The particular electrode material will be dependent upon the specific location of the swirler (e.g., before/after combustion) and hence the environmental conditions to which the swirler will be exposed. Possible electrode materials include: brass, copper, graphite, molybdenum, tungsten, ferrous materials, alloys comprising at least one of the foregoing (including superalloys), as well as combinations comprising at least one of the foregoing materials, such as steel, high temperature superalloys, and copper alloys. If the swirler is located upstream of the combustion or detonation chamber, the environmental conditions are less severe, and materials such as copper and copper alloys and stainless steel can be employed, while if the swirler is located downstream of the combustion or detonation chamber, the environmental conditions are more severe (higher temperature, more corrosive, etc.), and materials such as stainless steel, molybdenum, tungsten and high temperature superalloys can be employed.

Figure 4:
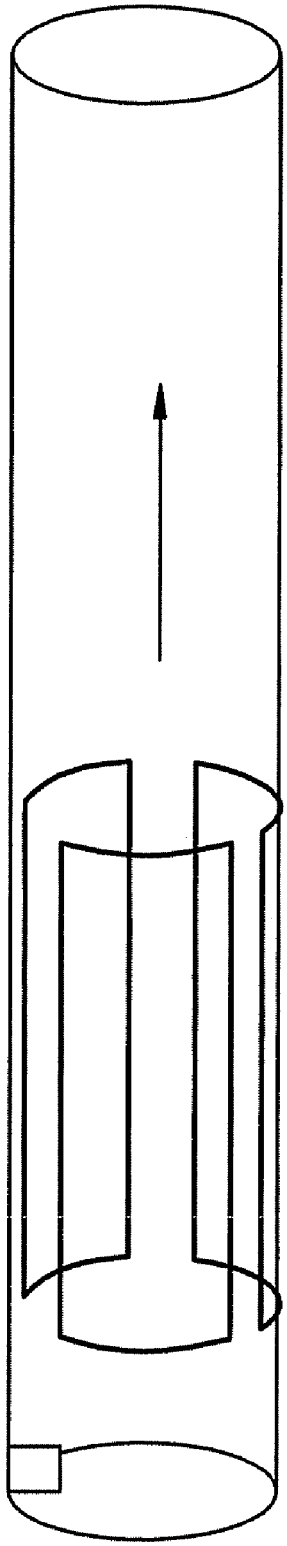
FIG. 4 is a perspective view of an exemplary configuration for a pulse detonation chamber.
Figure 5:
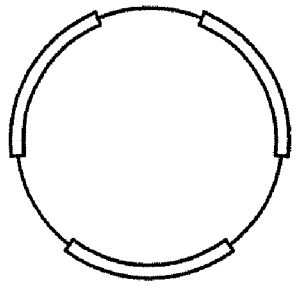
FIG. 5 is a top view of the pulse detonation chamber of FIG. 4.
Figure 6:
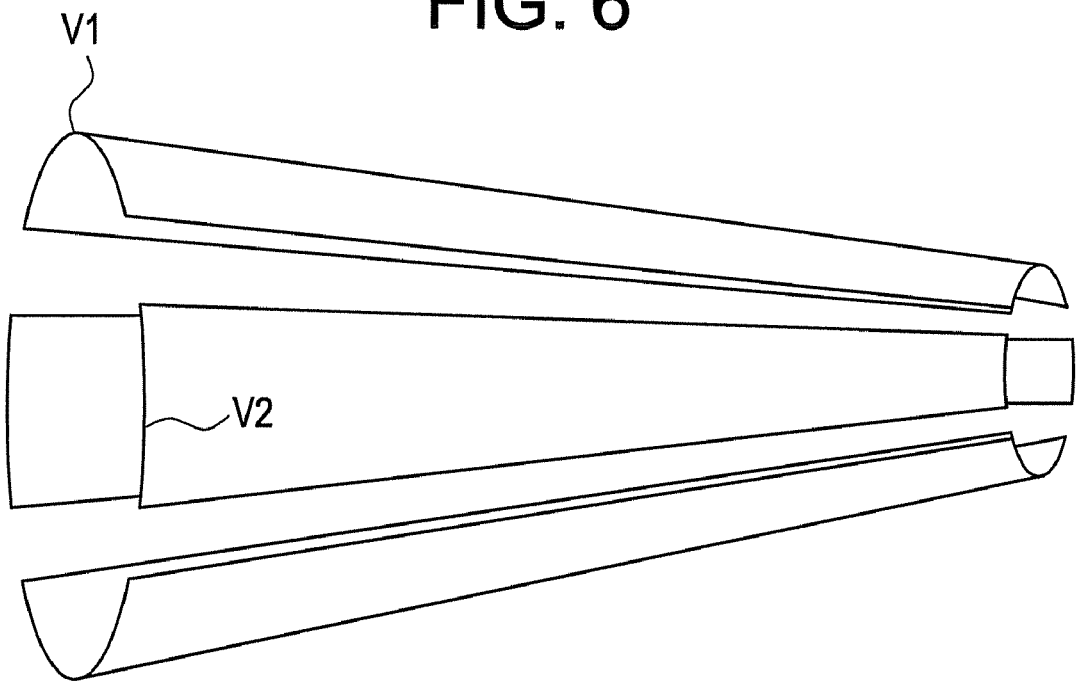
FIG. 6 is a perspective view of an exemplary conical electrode configuration of the electro-dynamic swirler.
Figure 7:
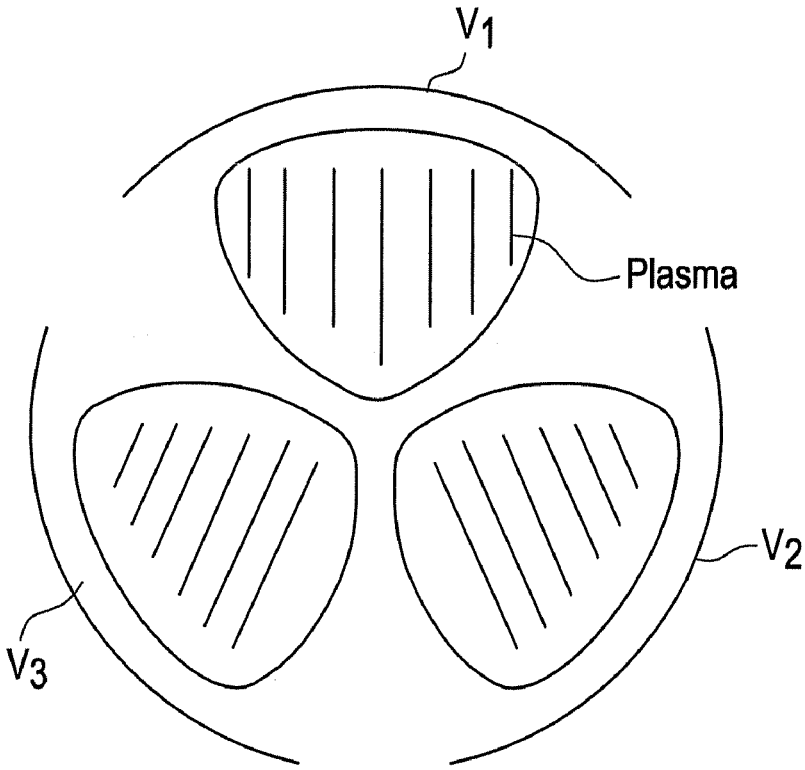
FIG. 7 is a perspective view of an exemplary three voltage set-up for a pulse detonation chamber such as in FIG. 4, in which the electrodes are oriented at 120 degrees to each other.
Figure 8:
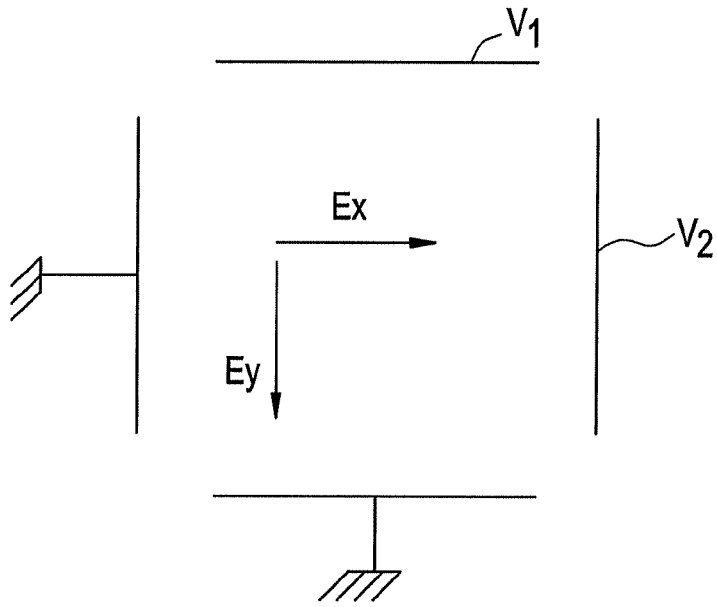
FIG. 8 illustrates an exemplary swirler set-up using two voltages applied orthogonally across the swirler volume, e.g., with the electrodes arranged in a square configuration.
Figure 9:
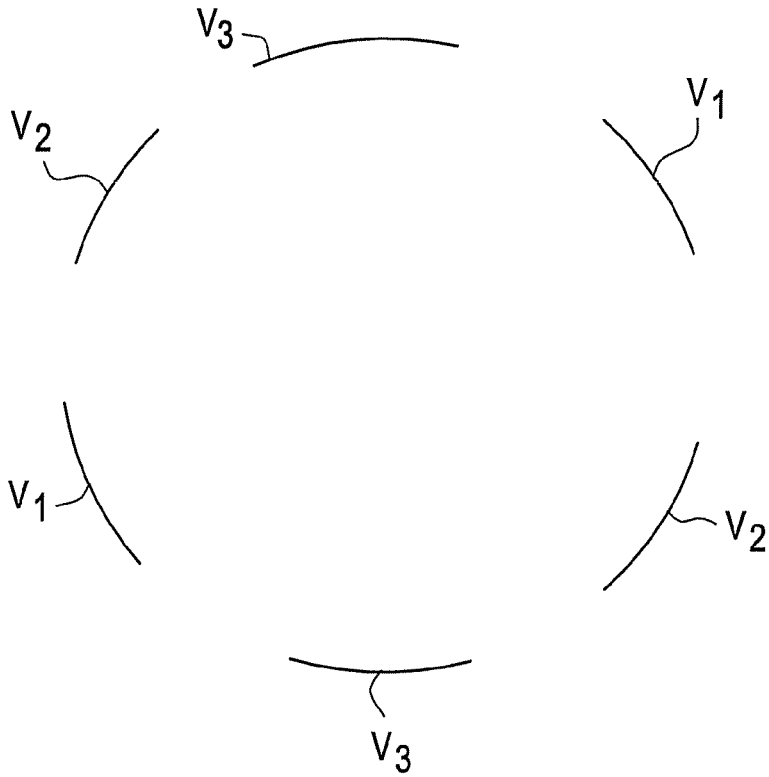
FIG. 9 illustrates an exemplary seven electrode configuration with a three voltage setup and two poles.

The electrodes are arranged and connected in groups so as to attain the desired rotating electric field when energized. For example, the electrodes can be arranged to form a cylinder (FIG. 4) and/or cone shape (FIG. 6), and can be located in electrical communication with a multi-phase voltage power supply. One possible configuration, as illustrated in FIGS. 5 and 6, comprises three cylindrical shell electrodes whose centers are equally spaced by 120 degrees. These electrodes can be attached to the acceleration section of a pulse detonation engine combustion chamber with the axis of the electrode shells aligned with the axis of the cylindrical shape of the combustion chamber. The number of electrodes employed can be greater than or equal to three. Desirably, the spacing between the electrodes is sufficiently large to prevent arcing between the electrodes. To prevent (when needed) a discharge between the electrodes, the electrodes can also be electrically insulated from one another. The phase of the voltage form that can be applied to these electrodes is also spaced by 120 degrees; and the frequency applied to each electrode can be sufficiently equal to produce the desired electric rotating field. In addition to the three electrode swirler, four orthogonal electrodes can produce a rotating electric field, as well as other variations that can use multiples of electrodes energized with a multiphase symmetrical or non-symmetrical voltage system. (See FIGS. 7 and 8)

The swirler can also have an overall cylindrical or conical envelope. An increase in the electrode spacing downstream can favor a plasma creation upstream and only a rotating field downstream. This offers the option of sequentially ionizing and rotating the air and air/fuel mixture.

Figure 2:
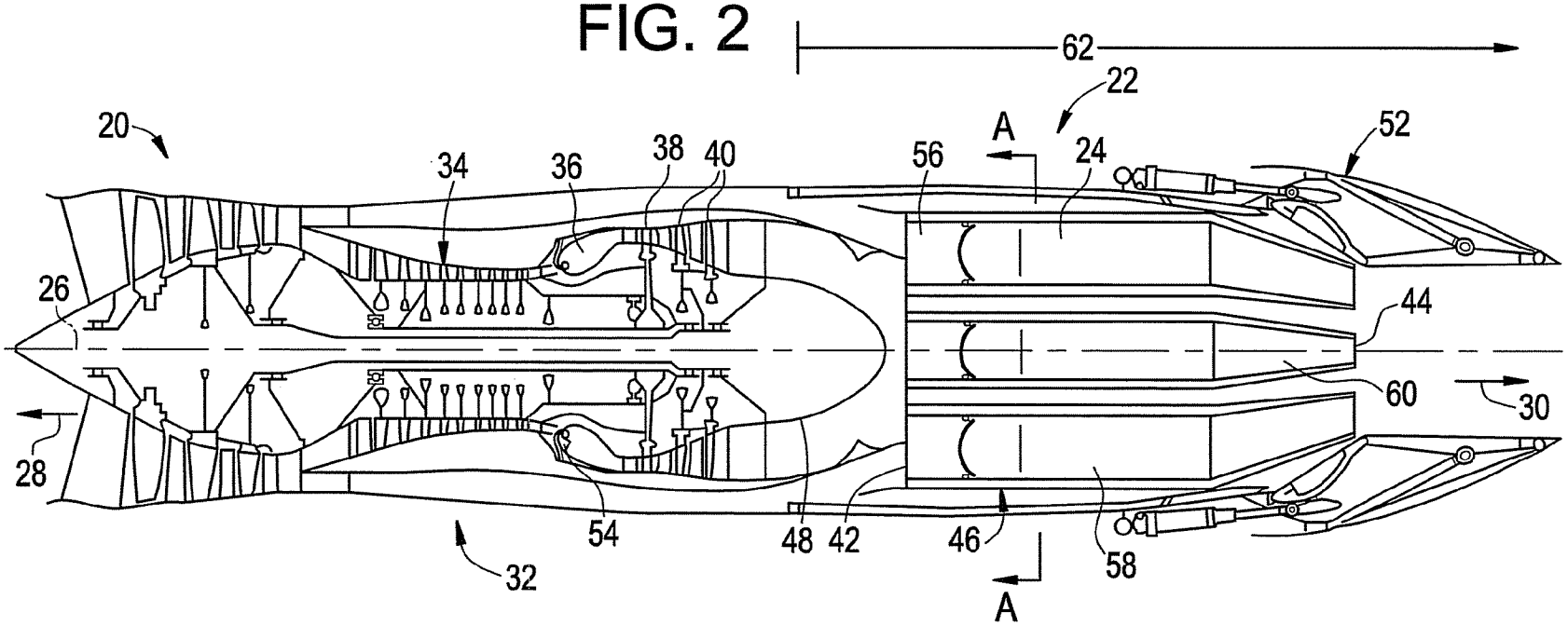
FIG. 2 is a cross-sectional side view of an exemplary turbofan engine including a pulse detonation system.
Figure 3:
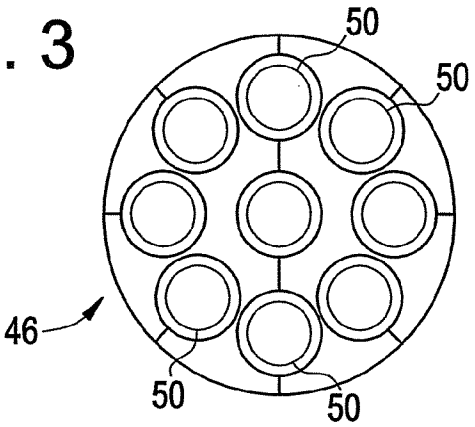
FIG. 3 is a cross-sectional view of a pulse detonation augmentor used with the pulse detonation system shown in FIG. 2 taken along lines A-A.

FIG. 2 is a cross-sectional side view of a turbofan engine 20 including a pulse detonation system 22. FIG. 3 is a cross sectional view of a pulse detonation augmentor 24 taken along lines A-A shown in FIG. 2. In one embodiment, turbofan engine 20 can be an F110/129 engine available from General Electric Aircraft Engines, Cincinnati, Ohio, with an engine (e.g., turbofan engine, pulse detonation engine, and so forth) (augmenter) 62. Engine 20 has a generally longitudinally extending axis or centerline 26 extending in a forward direction 28 and an aft direction 30. Engine 20 includes a core engine 32 which includes a high pressure compressor 34, a combustor 36 and, a high pressure turbine 38. It also has a fan and a low-pressure turbine that drives the fan, all arranged in a serial, axial flow relationship.

Pulse detonation system 22 is disposed downstream from the core engine 32 and receives core engine combustion gases from core engine 32. Pulse detonation system 22 creates a temperature rise and a pressure rise within engine 20 without the use of turbomachinery included within core engine 32 to generate thrust from engine 20. Pulse detonation system 22 includes pulse detonation augmentor 24 which includes an inlet side 42, an outlet side 44, and a shock tube sub-system 46. Inlet side 42 is upstream from outlet side 44 and circumferentially surrounds an engine centerbody 48.

Detonation tube sub-system 46 includes a plurality of shock tubes 50 (e.g., detonation chamber, including detonation tube, resonating detonation cavity, and annular detonation chamber) extending between pulse detonation augmentor inlet side 42 and pulse detonation augmentor outlet side 44. Shock tubes 50 permit fuel and air entering pulse detonation system 22 to mix and detonate. Each shock tube 50 and the shock tube sub-system 46 can have a circular or non-circular cross-sectional profile. Shock tubes 50 extend from core engine 32 to a converging-diverging exhaust nozzle 52. Exhaust nozzle 52 is disposed downstream from pulse detonation system 22 and shock tubes 50.

During operation, airflow enters engine 20 and fuel is introduced to core engine 32. The air and fuel are mixed (e.g., in a mixing area also referred to as mixing zone and mixing chamber) and ignited within core engine 32 to generate hot combustion gases. Specifically, pressurized air from high pressure compressor 34 is mixed with fuel in combustor 36. Optionally, the air and fuel are mixed in electro-dynamic swirler 54 located at the combustor 36. In the combustor 36, the mixture is ignited, thereby generating combustion gases. Such combustion gases drive high pressure turbine 38 which drives high pressure compressor 34. The combustion gases are discharged from high pressure turbine 38 into low pressure turbine 40. The core airflow is discharged from low pressure turbine 40.

The combined airflow is channeled into pulse detonation system 22 and mixed with additional fuel introduced to engine 20. Pulse detonation system 22 detonates the mixture to create a temperature rise and a pressure rise within engine 20, thus generating thrust from engine 20. The pulse detonation system 22 can optionally employ several electro-dynamic swirlers. The second electro-dynamic swirler 56 can be located upstream of the ignition location (e.g., spark) to mix the incoming fluids. One or more of the shock tubes 50 can comprise an electro-dynamic swirler 58 located downstream of the ignition point, e.g., to control and/or expand the flame, eliminate hot spots, and reduce the DDT length (compared to a system without the electro-dynamic swirler). The DDT length (obtained with out a swirler) is in the order of 10-15 tube diameters. Also, additional electrostatic swirler(s) 60 can be located further downstream (such as, near and or downstream of the detonation point), e.g., to control or direct the resultant flame.

As is noted above, one or more electro-dynamic swirlers can be disposed throughout an engine, e.g., before, in, and/or after a combustor, before, in, and/or after a detonation chamber, and/or at a nozzle. If the swirler is applied in a region with no ions in the gas, e.g. prior the combustion section, the gas mixture is pre-ionized. Each swirler can also be designed based upon its location and function, e.g., to supplement mixing, to perform mixing, to shape the flame, and so forth. Hence, the size, power, number of electrodes, electrode shape, can be determined based upon the location and function of the swirler. For example one can use a three electrode configuration with a 60 degree uniform spacing in between the electrodes, FIG. 7, and a tube diameter of 10 centimeters (cm). The maximum voltage difference applied between any two electrodes may not exceed a peak voltage of 150 kilovolts (kV). The frequency of the voltage waveform can be hertz (Hz) to several kilohertz (kHz) range. At a frequency of 60 Hz the electric field rotates at 3,600 rounds per minute. The optimum frequency is application dependent. Charge number density, gas viscosity and transverse velocity and electric field strength are determining parameters.

The present electro-dynamic swirler enables the application of electric energy to an ionized gas (such as a flame or plasma) and the imposition of momentum to neutral species by motion of charged particles. The use of the swirler can enable a more complete mixing of fuel and air, thereby helping to keep peak flame temperature lower, and reducing NOx emissions. Additionally, the pressure drop through the swirler section is decreased when using the electro-dynamic swirler compared to mechanical swirlers. Furthermore, the electro-dynamic swirler can enable directing of the flame, can reduce or eliminate hot spots, and can decrease DDT length. Additionally, employment of swirler(s) could enable active control of an engine. For example, data from monitoring of the flame, mixing of the gases, and/or temperature, can be used to determine the electric energy to be employed.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A combustion apparatus, comprising:

an oxidant inlet; a fuel inlet;

a mixing area in fluid communication with the fuel inlet and the oxidant inlet, and configured to mix fuel and oxidant to form a mixture;

a combustion zone in fluid communication with the mixing area and configured to combust the mixture;

a pulse detonation system located downstream from the combustion zone; and an outlet in fluid communication with the combustion zone;

wherein the mixing area, the combustion zone, and/or the outlet comprise an electro-dynamic swirler configured to swirl ionized gas, and wherein the electro-dynamic swirler comprises a plurality of electrodes in electrical communication with a power source, and wherein the plurality of electrodes are arranged and connected in groups to produce a rotating electric field.

2. The apparatus of claim 1, wherein the pulse detonation system comprises a mixing chamber in fluid communication with the outlet and with additional fuel and/or oxidant, a detonation chamber located downstream of and in fluid communication with the mixing chamber, and a detonation outlet located downstream of and in fluid communication with the detonation chamber.

3. The apparatus of claim 2, wherein the mixing chamber further comprises a second electro-dynamic swirler.

4. The apparatus of claim 3, wherein the detonation chamber further comprises an ignition location and a third electro-dynamic swirler located downstream of the ignition location.

5. The apparatus of claim 2, wherein the detonation outlet further comprises a second electro-dynamic swirler.

6. A pulse detonation apparatus, comprising:

a fuel inlet;

an oxidant inlet;

a mixing area in fluid communication with the fuel inlet and the oxidant inlet;

a detonation chamber located downstream of and in fluid communication with the mixing area; and a detonation outlet located downstream of and in fluid communication with the detonation chamber;

wherein the mixing area, detonation chamber, and/or detonation outlet comprise an electro-dynamic swirler, and wherein the electro-dynamic swirler comprises a plurality of electrodes in electrical communication with a power source.

7. The apparatus of claim 1, wherein the plurality of electrodes are arranged in groups approximately 180 degrees apart from each other.

8. The apparatus of claim 1, wherein the rotating electric field is produced by spacing a phase of a voltage to the plurality of electrodes by approximately 120 degrees.

9. The apparatus of claim 8, wherein a frequency applied to each electrode is approximately equal.

10. The apparatus of claim 1, wherein the plurality of electrodes are symmetrically arranged.

11. The apparatus of claim 1, wherein the plurality of electrodes are electrically insulated from one another.

12. The apparatus of claim 1, wherein the plurality of electrodes are arranged to form one of a cylinder and a cone.

* * * * *